US011377292B2

(12) United States Patent
Mejenborg et al.

(10) Patent No.: US 11,377,292 B2
(45) Date of Patent: Jul. 5, 2022

(54) LOTTERY TICKET BIN WITH PULL-OUT DRAWER AND FOLDING CABLE CONFIGURATION

(71) Applicant: Scientific Games International, Inc., Newark, DE (US)

(72) Inventors: Sten Hallundbaek Mejenborg, Cumming, GA (US); Mark Andrew Thompson, Buford, GA (US); James Jonathan Holbrook, Cumming, GA (US); Ian Robert Scott, Duluth, GA (US)

(73) Assignee: Scientific Games, LLC, Alpharetta, GA (US)

( * ) Notice: Subject to any disclaimer, the term of this patent is extended or adjusted under 35 U.S.C. 154(b) by 0 days.

(21) Appl. No.: 16/572,702

(22) Filed: Sep. 17, 2019

(65) Prior Publication Data

US 2020/0095053 A1 Mar. 26, 2020

Related U.S. Application Data

(60) Provisional application No. 62/733,876, filed on Sep. 20, 2018.

(51) Int. Cl.
*B65D 83/12* (2006.01)
*A63F 3/06* (2006.01)

(52) U.S. Cl.
CPC ..... *B65D 83/12* (2013.01); *A63F 3/065* (2013.01)

(58) Field of Classification Search
CPC ..... A63F 3/065; B65D 83/12; G07F 11/18; G07F 11/62; G07F 11/68; G07F 17/42
See application file for complete search history.

(56) References Cited

U.S. PATENT DOCUMENTS 6,095,624 A * 8/2000 Wilbert ..... G07B 3/04 312/293.3
6,428,226 B1 * 8/2002 Suzuki ..... B41J 13/106 400/642

(Continued)

FOREIGN PATENT DOCUMENTS

EP 2 202 752 A2 6/2010

OTHER PUBLICATIONS

EPO Search Report, dated Jan. 17, 2020.

*Primary Examiner* — Gene O Crawford
*Assistant Examiner* — Kelvin L Randall, Jr.
(74) *Attorney, Agent, or Firm* — Dority & Manning, P.A.

(57) ABSTRACT

A lottery ticket bin for use in multi-bin dispenser array includes a housing having an open top and a drawer that slides into and out of the housing, the drawer also having an open top and a ticket compartment for receipt of a supply of interconnected lottery tickets through the open top. A component section adjacent a front of the drawer includes a first cable connection port, and a second cable connection port is fixed to the housing adjacent the component section in a closed position of the drawer, the second cable connection port in communication with a circuit board fixed to an exterior of the housing. A cable is connected between the first and second cable connection ports and a length so as to accommodate a fully open position of the drawer relative to the housing. The cable folds into a cable storage section configured with the drawer.

14 Claims, 3 Drawing Sheets

(56) References Cited

U.S. PATENT DOCUMENTS

| | | | | |
|---|---|---|---|---|
| 6,575,090 | B1 * | 6/2003 | Vienneau | B41J 13/103 101/66 |
| 7,565,999 | B1 * | 7/2009 | Jensen | G07F 17/42 220/210 |
| 9,339,121 | B2 * | 5/2016 | Siciliano | A47F 1/125 |
| 9,626,483 | B2 * | 4/2017 | Barrett | G16H 20/13 |
| 2004/0000572 | A1 * | 1/2004 | Engelhardt, Jr. | G07B 3/02 225/1 |
| 2006/0003605 | A1 * | 1/2006 | Brooks | G07F 17/42 439/40 |
| 2009/0057398 | A1 * | 3/2009 | Douglass | G07F 19/00 235/379 |
| 2009/0086425 | A1 * | 4/2009 | Lai | H04M 1/0277 361/679.56 |
| 2010/0114367 | A1 * | 5/2010 | Barrett | G16H 40/60 700/236 |
| 2013/0175286 | A1 * | 7/2013 | Barrett | A61J 1/035 221/1 |
| 2014/0043162 | A1 | 2/2014 | Siciliano et al. | |
| 2014/0046481 | A1 * | 2/2014 | Siciliano | A47F 1/125 700/236 |
| 2017/0018148 | A1 | 1/2017 | Behm et al. | |
| 2020/0093249 | A1 * | 3/2020 | Myers | A46B 11/0013 |

* cited by examiner

LOTTERY TICKET BIN WITH PULL-OUT DRAWER AND FOLDING CABLE CONFIGURATION

PRIORITY

The present application claims the benefit of Provisional Application No. 62/733,876 filed Sep. 20, 2018.

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

For example, U.S. Pat. Publication No. 2017/0018148 describes a lottery ticket dispenser array that is configured in communication with a lottery ticket terminal and includes a plurality of separate dispensing bins having a different respective lottery ticket stored therein. For example, the dispenser array may include ten separate bins, with each bin containing a supply of different scratch-off lottery ticket games. Each lottery ticket contained in the bins includes a machine readable code printed thereon, such as a bar code, QR code, or the like. Each bin in the array includes an electronic drive mechanism that, when activated, dispenses one or more lottery tickets from the bin (depending on the number of tickets requested by the patron). Each bin also includes a scanner disposed to read the code on lottery tickets dispensed from the bin position. In operation of the system, the lottery ticket terminal transmits a purchase signal for dispensing a particular lottery ticket that is routed to the respective bin containing the lottery ticket, which activates the drive mechanism to dispense the requisite number of tickets. As the tickets are dispensed from the bin, the scanner may read the code printed on each ticket, which eventually results in a signal being routed to a central lottery server for each lottery ticket dispensed from the dispenser array. The code printed on each ticket contains identifying information unique to the ticket, and the signal transmitted to the central server enables actions relevant to the sale of the tickets, such as activating the ticket in the lottery provider's system, accounting for tickets sold at a particular retail establishment, reconciling tickets sold at a retail establishment with tickets delivered to the establishment, and for forth.

In the '148 publication, the individual interconnected bins within the array are in direct communication with a central lottery server. The array includes a bottom row of bins with interconnected base structures, wherein each base structure include a male power plug and male data plug along one side, and a female power port and female data port along the opposite side. The plugs and ports of adjacent base structures interconnect to essentially define a data bus running the length of the base structures. An exposed power port and data port at one of the ends of the interconnected base structures is available for connection with a power cord and a data cord from the controller or lottery terminal. Each bin includes a male power/data connector on the top or bottom surface, and a corresponding female power/data connector on the opposite surface. With this configuration, a plurality of the bins can be vertically stacked and interconnected, wherein the bottommost bin in each stack is connected to or contains one of the base structures such that the bins in each stack are connected in series to the data bus and, thus, to the controller.

With the array according to the '148 publication, the power/data connections are provided in the top and bottom panels of the individual bin housings at a relatively close distance to the front cover of the bin where the dispense mechanism, scanner and control board are located. Thus, it is a relatively easy task to connect/disconnect the power connections from the functional components of the bin when replacing the front covers or entire bins within the array. However, the array configuration is not well-suited for an "under-counter" environment wherein the array would be placed beneath a counter at the point of sale (POS) location. The array has a tall height profile due to the height of the individual bins and access into the bins to load the lottery tickets is only by opening the front cover of the bins, which would be extremely inconvenient for the lower bins if the array were placed on or close to the floor and under a counter.

A low profile "under counter" array could not use the individual bin and power/data connections like those of the '148 publication. The present invention provides a solution to this issue.

SUMMARY

Objects and advantages of the invention will be set forth in part in the following description, or may be obvious from the description, or may be learned through practice of the invention.

In accordance with aspects of the invention, a lottery ticket bin is provided for use in multi-bin dispenser array that is particularly suited as an "under-counter" array due to its low profile and ease of making the power/data connections within the bin. The bin includes a housing having an open top and an open-top drawer that is slidable into and out of the housing. The drawer includes at least one ticket compartment configured for receipt of a supply of interconnected lottery tickets, wherein the tickets can be loaded into the compartment through the open top of the drawer. A component section is within and adjacent a front of the drawer and is configured with control components that automatically dispense one or more of the lottery tickets through a dispense slot in the front of the drawer upon receipt of a dispense command. The component section may include, for example, a motorized drive mechanism, a scanner or other optical reader, a tear bar, a control board, and so forth.

The component section includes a first cable connection port, and a second cable connection port is disposed within and fixed to the housing adjacent the component section in a fully closed position of the drawer relative to the housing. The second cable connection is in communication with a circuit board fixed to an exterior of the housing. A power/data cable is connected between the first cable connection port and the second cable connection port and has a length so as to accommodate a fully open position of the drawer relative to the housing. A cable storage section is configured with the drawer at a location such that the cable folds into the cable storage section as the drawer is pushed back into the housing and is pulled from the storage section as the drawer is pulled out of the housing.

The relative locations of the first and second cable connection ports provides relatively easy access for a clerk or other personnel to connect/disconnect the cable from the housing in order to replace or service one of the drawers.

In a particular embodiment, the circuit board is fixed to an exterior back side of the housing and a connector extends between the circuit board and the second cable connection port, which may be disposed on a floor of the housing. The connector may run along the floor of the housing between the circuit board and the second cable connection. The cable storage section may be located above the floor of the housing over the connector such that the cable folds into the cable storage section above the connector.

The cable storage section may be a chamber disposed longitudinally within the drawer between the component section and a back wall of the drawer. The chamber may be defined in a side wall of the drawer. In a particular embodiment, the drawer is configured to store and dispense at least two separate supplies of lottery tickets and comprises adjacent component sections and adjacent ticket compartments, wherein the chamber is defined in a wall in the drawer that separates the ticket compartments. In this embodiment, the circuit board may be fixed to an exterior back side of the housing and connected to the second cable connection port via a connector disposed in the middle and on a floor of the housing, wherein the connector is located within the chamber in the fully closed position of the drawer. Preferably, the chamber has a height such that the cable folds into the chamber above the connector.

The cable may be attached to a wall of the chamber, such as the upper wall of the chamber, wherein an unattached length of the cable is the portion that folds into the chamber and provides the length necessary to slide the drawer out of the housing to the fully open position.

The present invention also encompasses a lottery ticket dispenser array that includes a plurality of the bins described above in an interconnected configuration.

Aspects of the lottery ticket bin and dispenser array will be described in greater detail below.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
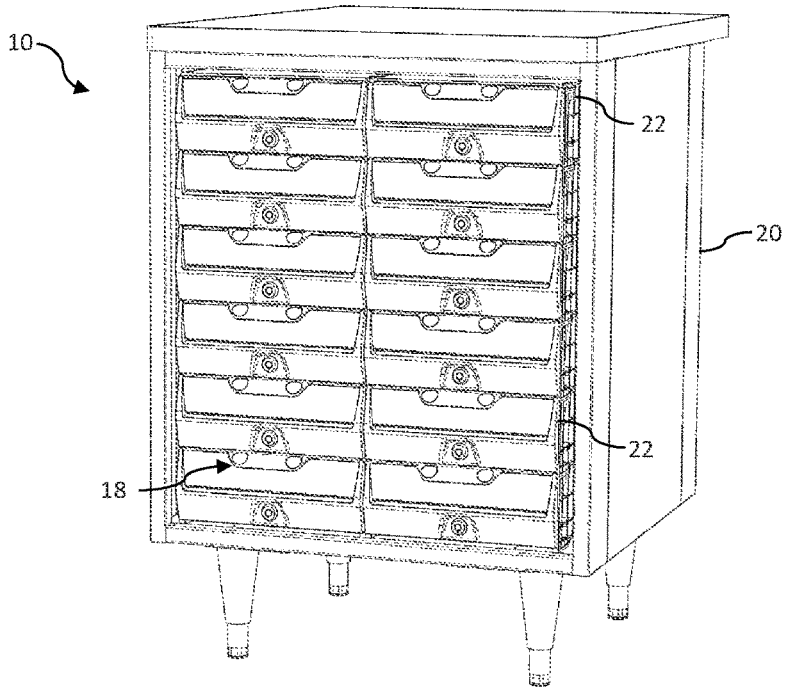
FIG. 1 is a perspective view of an embodiment of a lottery ticket dispenser array within a cabinet in accordance with aspects of the present invention.

FIG. 1 depicts an embodiment of a dispenser array 10 for dispensing lottery tickets (not shown) at a retail establishment, such as a convenience store, retail store, pub, restaurant, or the like, that is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment or lottery jurisdiction entities are not limiting factors of the invention.

Figure 2:
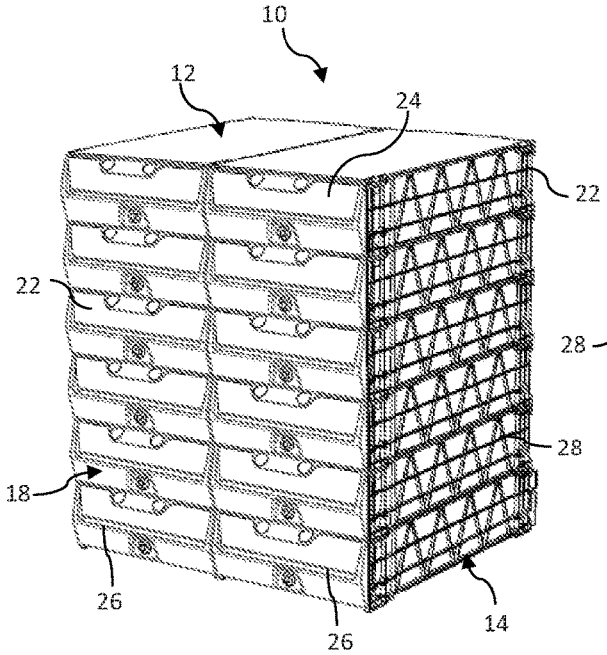
FIG. 2 is a front perspective view of the lottery ticket dispenser array removed from the cabinet.
Figure 3:
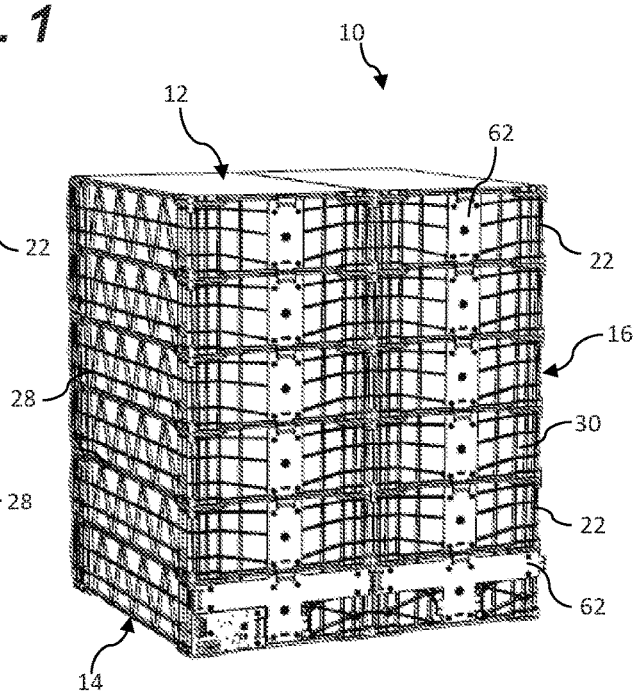
FIG. 3 is a back perspective view of an embodiment of a lottery ticket dispenser array.

Referring to FIGS. 1-3 in general, the array 10 includes a plurality of separate ticket bins 22 (described in greater detail below) that, collectively, define a top 12, sides 14, back 16, and front 18 of the array 10. The bins 22 may be physically interconnected within the array by any manner of suitable structure provided on the sides, top, or bottom of the bins 22. Each bin 22 has a front face 24 with a dispensing slot 26 through which lottery tickets contained in the bin 22 are dispensed.

In the depicted embodiment, the bins 22 (and hence the array 10) have a relatively low height profile and are designed to contain a stack of fan-folded lottery tickets laid flat in the respective bins 22. This configuration is particularly well-suited for an "under-counter" system wherein the array 10 is operationally located within a cabinet 20 (FIG. 1) that is sized to fit under a retail counter. This arrangement removes the array from on or above the retail counter and frees up valuable space at the point of sale (POS) counter at the retail establishment, which is highly desirable to retailers.

Referring to FIGS. 4*a* through 5*b*, each bin 22 defines at least one internal ticket compartment 40 for receipt of a supply of lottery tickets, for example in the form of a fan-folded stack of interconnected tickets or a roll of interconnected tickets. In the depicted embodiment, each bin 22 is configured to house and dispense two separate supplies of lottery tickets and includes side-by-side ticket compartments 40 separated by an internal wall 50. Each ticket compartment 40 includes an operational component section 38 at the front thereof that may include a drive mechanism, scanner or other type of reader, cutting bar or mechanism, control circuitry, and so forth. It should be appreciated that each bin 22 may include any number of ticket compartments 40 and associated component sections 38.

Each bin 22 has an open-top housing structure 28 that includes sides 32 and a back side 30. The back sides 30 collectively define the back 16 of the dispenser array 10. A circuit board 62 is fixed to an exterior of the back side 30 of each bin housing 28 and is configured to supply power and control functions to the bin, in particular to the component section 38. For example, as mentioned, each bin 22 (or component section 38 within the bin 22) may include a drive mechanism that dispenses an individual lottery ticket from the bin 22 through the dispense slot 26 upon receipt of a dispense signal via the circuit board 62, wherein power to the drive mechanism is also provided via the circuit board 62. Each bin 22 (or component section 38) may also include a scanner that reads a code on the lottery ticket as the ticket is dispensed, wherein power to the scanner is provided via the circuit board 62 and the scanned code is transmitted from the scanner via the circuit board 62 to a downstream controller or central lottery server/computer that is in communication with the dispenser array 10. It should be appreciated that the array 10 is not limited by the power or control functions that are provided by the circuit boards 62 or performed by the operational components within the component section 38.

Each bin 22 includes an open-top drawer 36 that is slidable into and out of the housing 28. The drawer includes sides 42, front wall 44, floor 48, and a back wall 46. In the illustrated embodiment, the drawer 36 includes the one or more ticket compartments 40, wherein the tickets can be loaded into the compartment through the open top of the drawer. Also the component sections 38 are configured within and adjacent a front wall 44 of the drawer 36, and the dispense slot 26 is defined in the front wall 44 of the drawer 36.

Figure 6A:
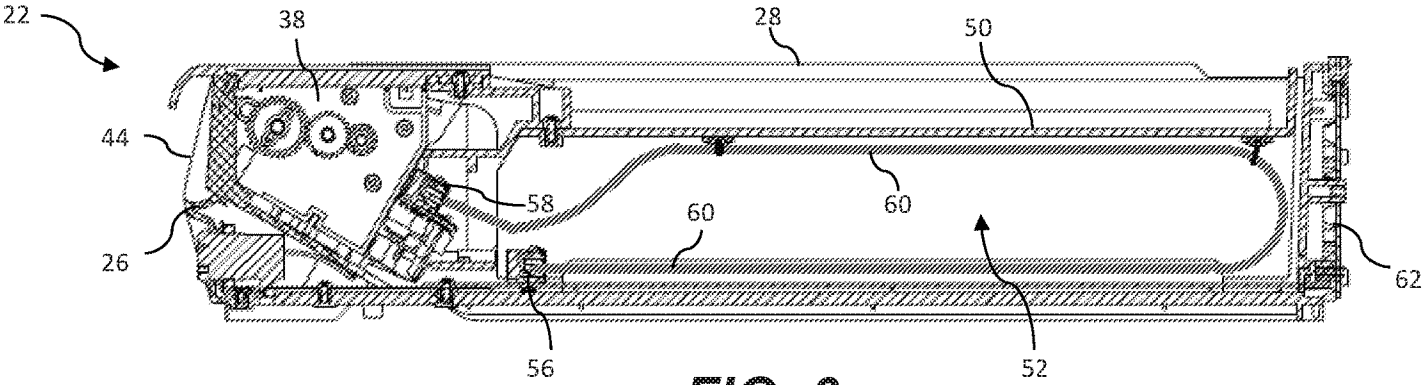
FIG. 6*a* is a side cut-away view of a bin with the drawer in a fully closed position.
Figure 6B:
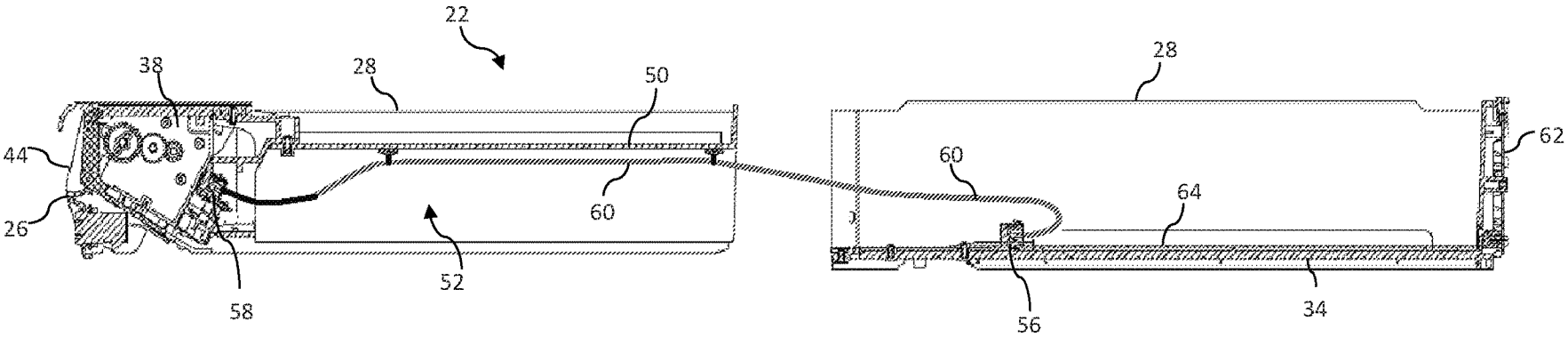
FIG. 6*b* is a side cut-away view of the bin of FIG. 6*a* with the drawer in an open position.

Referring in general to FIGS. 6*a* and 6*b*, the component section 38 includes a first cable connection port 56 having any suitable connector structure. A second cable connection port 58 is disposed within and fixed to the housing 28 adjacent the component section 38 in a fully closed position of the drawer 36 relative to the housing 28. The second cable connection 58 is in communication with the circuit board 62 fixed to the bin housing 28. A power/data cable 60 is connected between the first cable connection port 56 and the second cable connection port 58 and has a length so as to accommodate a fully open position of the drawer 36 relative to the housing 28, as depicted in FIG. 6*b*. A cable storage section 54 is configured with the drawer 36 at a location such that the cable 60 folds into the cable storage section 54 as the drawer 36 is pushed back into the housing 28 (FIG. 6*a*) and is pulled from the storage section 54 as the drawer 36 is pulled out of the housing 28 (FIG. 6*b*).

The relative locations of the first 56 and second 58 cable connection ports provides relatively easy access for a clerk or other personnel to connect/disconnect the cable 60 from the housing 28 with the drawer 36 in an open position in order to replace or service one of the drawers 36.

In the illustrated embodiment, wherein the circuit board 62 is fixed to an exterior of the back side 30 of the housing 28, a connector 64 extends between the circuit board 62 and the second cable connection port 58, which may be disposed on the floor 34 of the housing 28. The connector 64 may be hard-wired between the circuit board 64 and the second cable connection port 58. In a particular embodiment, the cable storage section 54 may be located above the floor 34 of the housing 28 over the connector 64 such that the cable 60 folds into the cable storage section 54 above the connector 64.

Figure 4B:
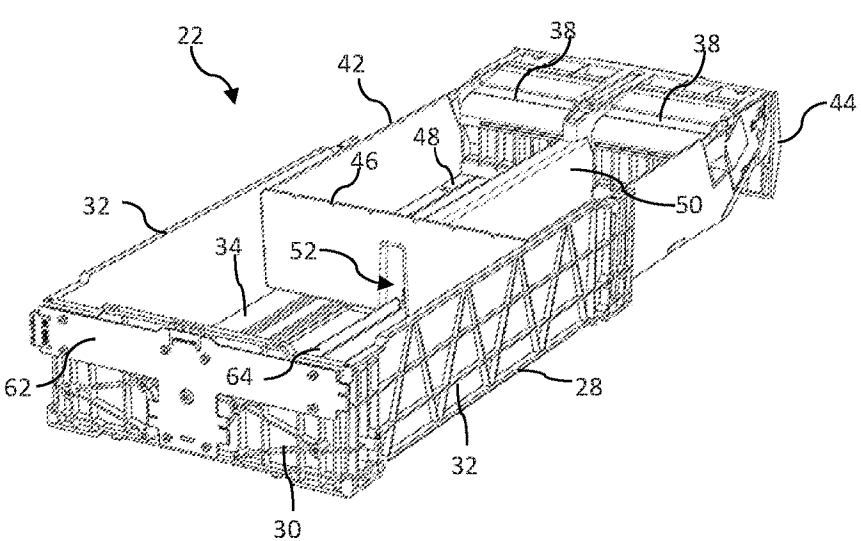
FIG. 4*b* is a back perspective view of the bin of FIG. 4*a* with the drawer in an open position.
Figure 4A:
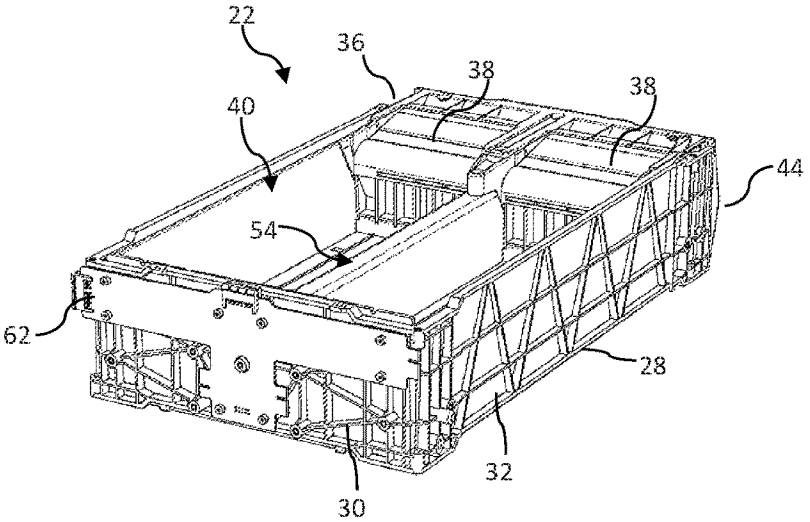
FIG. 4*a* is a back perspective view of an individual ticket bin from the lottery ticket dispenser array of FIG. 2.
Figure 5B:
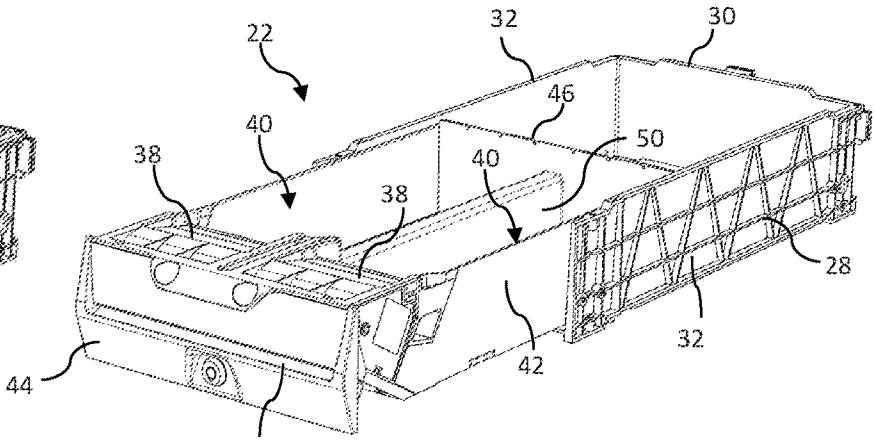
FIG. 5*b* is a front perspective view of the bin of FIG. 5*a* with the drawer in an open position.
Figure 5A:
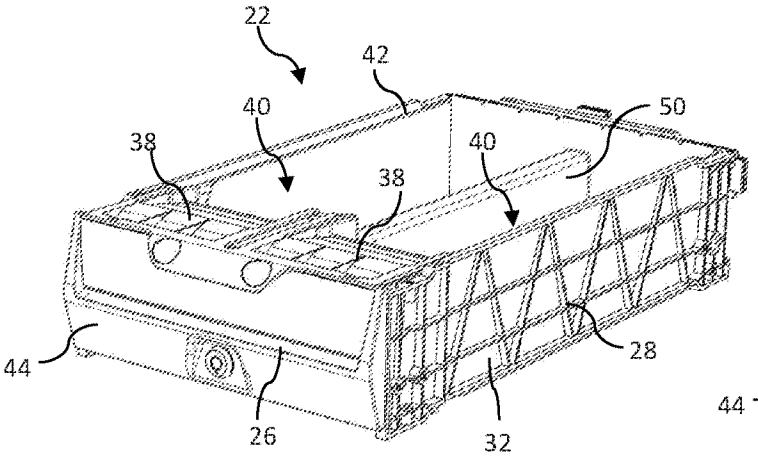
FIG. 5*a* is a front perspective view of an individual ticket bin from the lottery ticket dispenser array of FIG. 2.

The cable storage section 54 may be variously configured. In the illustrated embodiment, a chamber 52 is disposed longitudinally within the drawer 36 between the component section 38 and back wall 46 of the drawer 36. For example, the chamber 52 may be defined in a side wall 42 of the drawer 36. In the illustrated embodiment wherein the drawer 36 is configured to store and dispense at least two separate supplies of lottery tickets and includes adjacent ticket compartments 40 separated by an internal wall 50, the chamber 52 may have an open bottom and be defined in the intermediate wall 50, as seen in FIGS. 4*b* and 6*a*-6*b*. In this embodiment, the connector 64 may be disposed in the middle and on the floor 34 of the housing 28 and is located within the chamber 52 in the fully closed position of the drawer 36, as depicted in FIG. 6*a*. The chamber 52 has a height such that the cable folds into the chamber above the connector 64.

As seen in FIGS. 6*a*-6*b*, the cable 60 may be attached to a wall of the chamber 52, such as the upper or top wall of the chamber 52, wherein an unattached length of the cable 60 is the portion that folds into the chamber 52 and provides the length necessary to slide the drawer 36 out of the housing to the fully open position (FIG. 6*b*).

As discussed, the present invention also encompasses a lottery ticket dispenser array 10 that includes a plurality of the bins 22 described above in an interconnected configuration.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket bin for use in multi-bin dispenser array, comprising:

a housing having an open top;

a drawer slidable into and out of the housing, the drawer comprising an open top and at least one ticket compartment configured for receipt of a supply of interconnected lottery tickets;

a component section forward of the ticket compartment and adjacent a front of the drawer that automatically dispenses one or more of the lottery tickets through a dispense slot upon receipt of a dispense command, the component section comprising a first cable connection port at a front of the drawer adjacent the component section;

a second cable connection port disposed within and fixed to the housing adjacent the component section at a front of the drawer in a fully closed position of the drawer relative to the housing, the second cable connection in communication with a circuit board fixed to an exterior of the housing;

a cable connected between the first cable connection port and the second cable connection port, the cable having a length so as to accommodate a fully open position of the drawer relative to the housing;

a cable storage section configured with within the drawer at a location such that the cable folds into the cable storage section within the drawer as the drawer is pushed back into the housing; and wherein the cable storage section is defined in the ticket compartment of the drawer between side walls of the drawer and above a bottom of the drawer and comprises a closed chamber defined by walls disposed longitudinally within ticket compartment between the component section and a back wall of the drawer such that the cable storage section divides the ticket compartment.

2. The lottery ticket bin as in claim 1, wherein the circuit board is fixed to an exterior back side of the housing, and further comprising a connector between the circuit board and the second cable connection port.

3. The lottery ticket bin as in claim 2, wherein the second cable connection port is disposed on a floor of the housing and the connector runs along the floor of the housing between the circuit board and the second cable connection.

4. The lottery ticket bin as in claim 3, wherein the cable folds into the cable storage section above the connector.

5. The lottery ticket bin as in claim 1, wherein the drawer is configured to store and dispense at least two separate supplies of lottery tickets and comprises adjacent component sections and adjacent ticket compartments.

6. The lottery ticket bin as in claim 1, wherein the circuit board is fixed to an exterior back side of the housing and is connected to the second cable connection port via a connector disposed on a floor of the housing, the chamber having a height such that the cable folds into the chamber above the connector.

7. The lottery ticket bin as in claim 6, wherein the cable is attached to an upper wall of the chamber.

8. A lottery ticket dispenser array, comprising:

a plurality of interconnected bins, wherein each bin further comprises:

a housing having an open top;

a drawer slidable into and out of the housing, the drawer comprising an open top and at least one ticket compartment configured for receipt of a supply of interconnected lottery tickets;

a component section forward of the ticket compartment and adjacent a front of the drawer that automatically dispenses one or more of the lottery tickets through a dispense slot upon receipt of a dispense command, the component section comprising a first cable connection port at a front of the drawer adjacent the component section;

a second cable connection port disposed within and fixed to the housing adjacent the component section at a front of the drawer in a fully closed position of the drawer relative to the housing, the second cable connection port in communication with a circuit board fixed to an exterior of the housing;

a cable connected between the first cable connection port and the second cable connection port, the cable having a length so as to accommodate a fully open position of the drawer relative to the housing;

a cable storage section configured with within the drawer at a location such that the cable folds into the cable storage section within the drawer as the drawer is pushed back into the housing; and wherein the cable storage section is defined in the ticket compartment of the drawer between side walls of the drawer and above a bottom of the drawer and comprises a closed chamber defined by walls disposed longitudinally within the ticket compartment between the component section and a back wall of the drawer such that the cable storage section divides the ticket compartment.

9. The lottery ticket dispenser array as in claim 8, wherein the circuit board is fixed to an exterior back side of the housing, and further comprising a connector between the circuit board and the second cable connection port.

10. The lottery ticket dispenser array as in claim 8, wherein the second cable connection port is disposed on a floor of the housing and the connector runs along the floor of the housing between the circuit board and the second cable connection.

11. The lottery ticket dispenser array as in claim 10, wherein the cable folds into the cable storage section above the connector.

12. The lottery ticket dispenser array as in claim 8, wherein the drawer is configured to store and dispense at least two separate supplies of lottery tickets and comprises adjacent component sections and adjacent ticket compartments.

13. The lottery ticket dispenser array as in claim 8, wherein the circuit board is fixed to an exterior back side of the housing and is connected to the second cable connection port via a connector disposed on a floor of the housing, the chamber having a height such that the cable folds into the chamber above the connector.

14. The lottery ticket dispenser array as in claim 13, wherein the cable attached to an upper wall of the chamber.

* * * * *